US007870813B2

(12) United States Patent
Ham et al.

(10) Patent No.: US 7,870,813 B2
(45) Date of Patent: Jan. 18, 2011

(54) RADIO FREQUENCY JAMMER METHOD

(75) Inventors: Christopher V. Ham, Las Cruces, NM (US); Troy E. Scoughton, Las Cruces, NM (US)

(73) Assignee: TMC Design Corporation, Las Cruces, NM (US)

( * ) Notice: Subject to any disclaimer, the term of this patent is extended or adjusted under 35 U.S.C. 154(b) by 595 days.

(21) Appl. No.: 11/964,288

(22) Filed: Dec. 26, 2007

(65) Prior Publication Data

US 2010/0282052 A1 Nov. 11, 2010

Related U.S. Application Data

(62) Division of application No. 11/062,296, filed on Feb. 11, 2005, now Pat. No. 7,318,368.

(60) Provisional application No. 60/543,615, filed on Feb. 11, 2004.

(51) Int. Cl.
*H04K 3/00* (2006.01)

(52) U.S. Cl. ..... 89/1.11

(58) Field of Classification Search ..... 89/1.11; 342/13–21, 61, 68, 82–88, 89–103, 175, 342/192–197; 455/1; 86/50
See application file for complete search history.

(56) References Cited

U.S. PATENT DOCUMENTS 3,949,300 A * 4/1976 Sadler ..... 455/1
4,317,214 A * 2/1982 Attinello ..... 455/1
4,581,767 A * 4/1986 Monsen ..... 455/67.11
4,719,649 A * 1/1988 Woodsum et al. ..... 455/1
6,429,768 B1 8/2002 Flick
6,496,703 B1 12/2002 da Silva
6,512,803 B2 1/2003 Heinzl et al.
6,771,946 B1 8/2004 Oyaski
7,023,374 B2 * 4/2006 Jossef et al. ..... 342/20
7,138,936 B2 * 11/2006 Duff et al. ..... 342/14
7,423,575 B2 * 9/2008 Duff et al. ..... 342/14
2002/0012411 A1 1/2002 Heinzl et al.
2002/0102968 A1 8/2002 Arend et al.
2002/0186150 A1 12/2002 Sweetapple
2003/0054756 A1 3/2003 Tyson et al.
2004/0077339 A1 4/2004 Martens
2004/0242149 A1 * 12/2004 Luneau ..... 455/1
2004/0263378 A1 * 12/2004 Jossef et al. ..... 342/20
2006/0105701 A1 * 5/2006 Cornwell ..... 455/1
2006/0164282 A1 * 7/2006 Duff et al. ..... 342/14
2007/0268174 A1 11/2007 Ham et al.
2008/0191924 A1 * 8/2008 Duff et al. ..... 342/14

* cited by examiner

*Primary Examiner*—Troy Chambers
(74) *Attorney, Agent, or Firm*—Deborah A. Peacock; Philip D. Askenazy; Peacock Myers, P.C.

(57) ABSTRACT

A method for broadcasting electromagnetic waves such that user-selected electromagnetic receivers are prevented from receiving an intended electromagnetic communication.

18 Claims, 7 Drawing Sheets

| Threat | Center Frequency | Bandwidth | Power Level | Card | Channel |
|---|---|---|---|---|---|
| A | 27.25 MHz | 2.5 MHz | High | HF | 1A |
| B | 35 MHz | 2.0 MHz | High | HF | 1B |
| C | 47.5 MHz | 5.0 MHz | High | VHF1 | 2A |
| D | 75 MHz | 1.0 MHz | High | VHF1 | 2B |
| E | 260 MHz | 10.0 MHz | High | UHF1 | 3A |
| F | 309 MHz | 22.0 MHz | High | UHF1 | 3B |
| G | 372 MHz | 36.0 MHz | High | UHF1 | 4A |
| H | 425.5 MHz | 21.0 MHz | High | UHF1 | 4B |
| I | 807 MHz | 10.0 MHz | High | L-BAND | 5A |
| J | 842.5 MHz | 20.0 MHz | High | L-BAND | 5B |

Fig. 2

SSVJ Block Diagram

BM-03-30 Biconical Monopole Antenna

Total Gain, Theta=90, Freq=500 Mhz, File=BM_03A

BM-03-30 Biconical Monopole Antenna

Total Gain, Phi=0, Freq=500 Mhz, File=BM_03A

RADIO FREQUENCY JAMMER METHOD

CROSS-REFERENCE TO RELATED APPLICATIONS

This application is a divisional application of U.S. patent application Ser. No. 11/062,296, entitled Radio Frequency Jammer, filed on Feb. 11, 2005, which itself claims priority to and the benefit of the filing of U.S. Provisional Patent Application Ser. No. 60/543,615, entitled "Radio Frequency Jammer", filed on Feb. 11, 2004 and the specifications and claims thereof are incorporated herein by reference.

BACKGROUND OF THE INVENTION

1. Field of the Invention (Technical Field)

The present invention relates to Radio Frequency (RF) jamming devices. Particularly, the present invention relates to an RF jamming method which preferably operates at the same frequencies as those used to remotely detonate explosives commonly referred to as Improvised Explosive Devices (IEDs).

2. Description of Related Art

IEDs are explosive devices that are remotely detonated. These devices are used by military units, terrorist organizations, resistance groups, guerilla groups and the like, and are frequently employed to damage or destroy vehicles by remotely exploding an IED, by means of a radio frequency signal, when the vehicle comes within range of the IED. IED devices can also be employed against stationary targets, such as by having an IED in a vehicle that is parked in proximity to a target, and remotely detonating the IED. IEDs are a significant military challenge and threat. It is against this background that the present invention was developed.

BRIEF SUMMARY OF THE INVENTION

The present invention is a method for preventing the detonation of a radio frequency controlled explosive device, the method comprising the steps of: selecting a frequency range, said range comprising the operating frequency of a receiver of the explosive device; and transmitting electromagnetic waves comprising Gaussian noise at frequencies of the selected frequency range, wherein the transmitting step comprises transmitting electromagnetic waves having a power of at least 10 watts.

A primary object of the present invention is to provide a low cost method which saves lives and property from the destructive effects of explosive devices which are remotely detonated using radio frequencies.

Another object of the present invention is to provide a method wherein a jamming device can be operated by untrained personnel in the field.

A primary advantage of the present invention is that it can be easily programmed in response to changing threats.

Another advantage of the present invention is that multiple different threats, which use different frequencies or modulation modes, may be eliminated simultaneously.

A further advantage of the present invention is that a user can prevent the detonation of radio frequency controlled explosive devices regardless of whether the user is moving or stationary.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 2 is a table showing various frequencies commonly used in explosive devices for various regions of the world, as well as the power typically employed;

DETAILED DESCRIPTION OF THE INVENTION

The present invention is a low cost, portable, programmable jamming device method that prevents detonation of remote controlled explosive devices.

The term "vehicle" as used throughout the specification and claims is used for the sake of simplicity and is intended to include any and all types of vehicles, including but not limited to those capable of traveling through the air, on the ground, across water, through water, or combinations thereof. While the term "vehicle" includes any device, apparatus, and/or structure capable of transporting people, the term "vehicle" is not limited to only those devices, apparatuses and/or structures capable of transporting people, but can also include devices, apparatuses, and/or structures capable of carrying cargo, including but not necessarily limited to the apparatus of the present invention. As such, the term "vehicle" can include a person carrying the apparatus of the present invention.

The present invention is directed to a method of jamming Radio Frequency (RF) devices, particularly to jamming Improvised Explosive Devices (IEDs) as well as other remotely detonated explosives. While the present invention can of course be used in a stationary manner, such as, for example, in or near an encampment, building, or other structure having a geographic location which remains fixed for extended periods of time, the present invention is also capable of operating while traveling and thus can be used with virtually any type of vehicle.

The present invention preferably interferes with remote control devices which can be used to detonate IEDs. The present invention is capable of protecting vehicles by blocking RF signals within an effective radius of the IED, thus preventing RF detonated devices from exploding near the present invention. In one embodiment, the present invention is preferably mounted in or on a vehicle. Vehicles having the present invention mounted thereon or therein are thus able to prevent RF triggered IEDs from exploding near them and are thus protected therefrom. The present invention is highly effective, rugged, and can be produced in large quantities in a short period of time.

Figure 1:
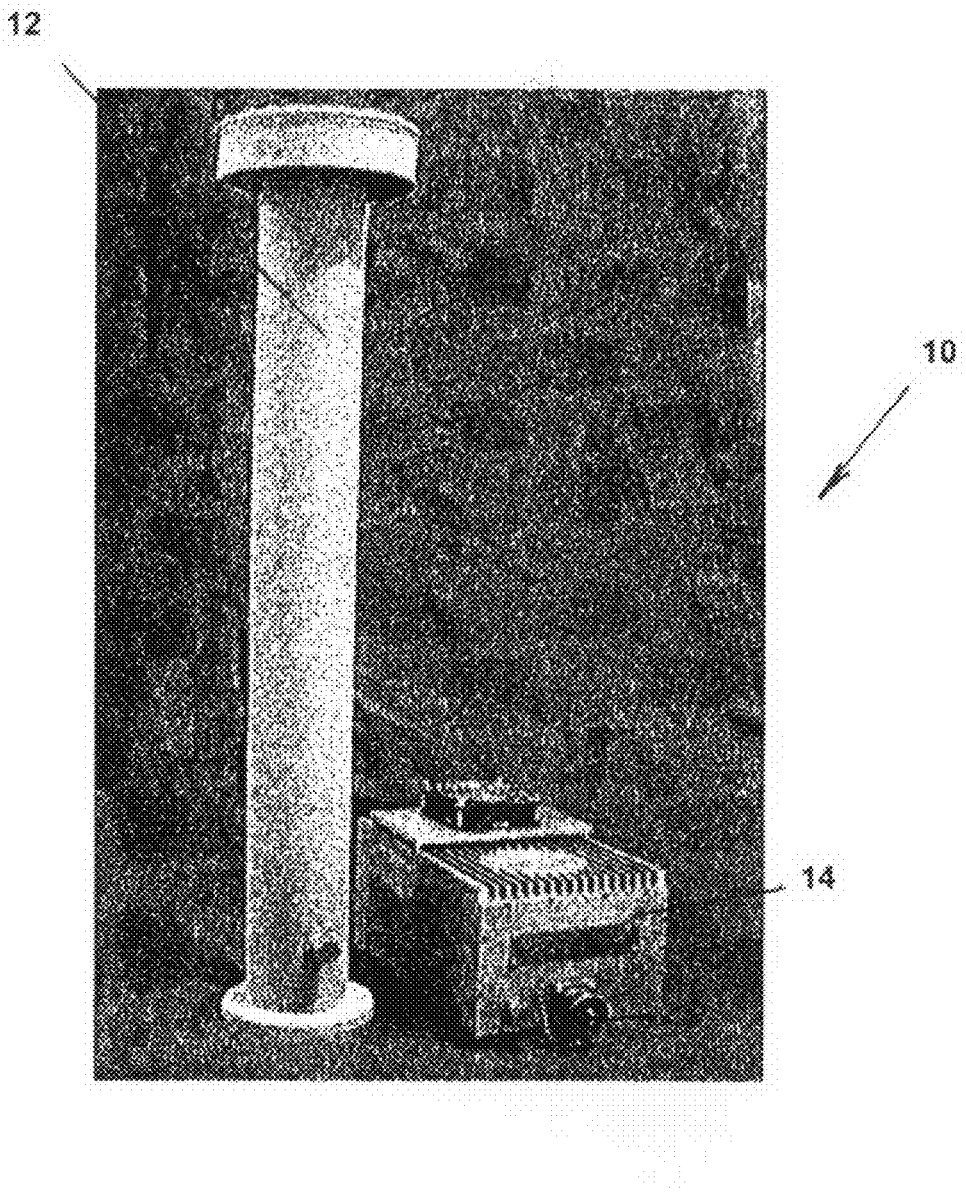
FIG. 1 is a photograph depicting a preferred embodiment of the present invention.
Figure 3:
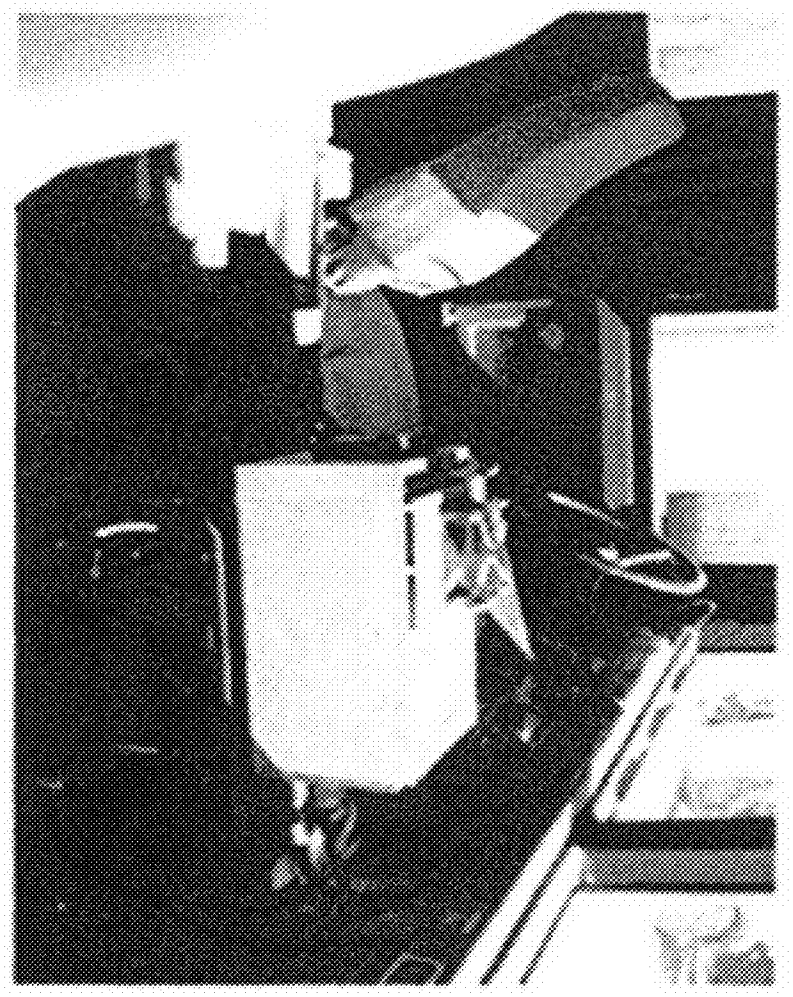
FIG. 3 is an image showing a side view of an electronics unit of a preferred embodiment of the present invention.

FIG. 1 shows an embodiment of RF jammer 10 of the present invention. As depicted therein, jammer 10 preferably comprises a plurality of electromagnetic radiating devices 12 and electronics unit 14. FIG. 3 depicts a side view of electronics unit 14 disposed in a vehicle. For reference, FIG. 2 is included and shows the frequencies, regions, and power which can be used in accordance with the RF jammer of the present invention.

The present invention preferably produces simultaneous and continuous interfering electromagnetic waves, preferably comprising Gaussian noise, in one or more frequency ranges which correspond with and block those frequencies typically associated with an IED (20-1000 MHz). The actual frequencies, bandwidths, and power levels of the interfering electromagnetic waves produced by the present invention are preferably programmable and may be changed as the IEDs used are changed. The modulation mode used is also preferably programmable, and comprises one or modes known in the art, including but not limited to $\Delta P/\Delta T$, $\Delta F/\Delta T$, and frequency hop modes. The exact frequencies and bandwidths used in accordance with the present invention are preferably determined and programmed based on the most recent information available. With the ability to program jammer 10, the ability to adapt to changing tactics used by those making and using IEDs is thus realized.

Figure 6A:
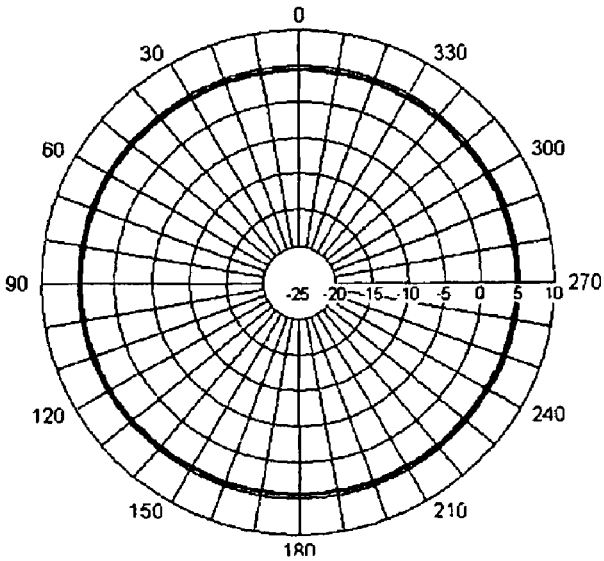
FIGS. 6A, 6B and 6C are charts depicting the elevation and azimuth patterns produced by the present invention.
Figure 6B:
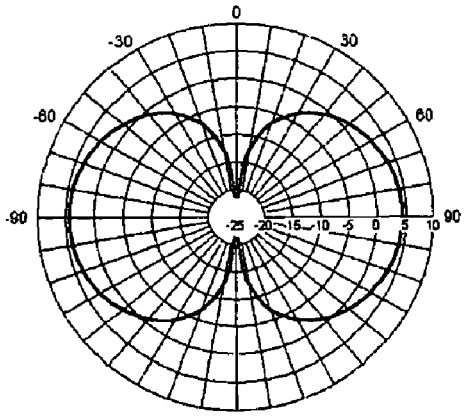
Figure 6C:
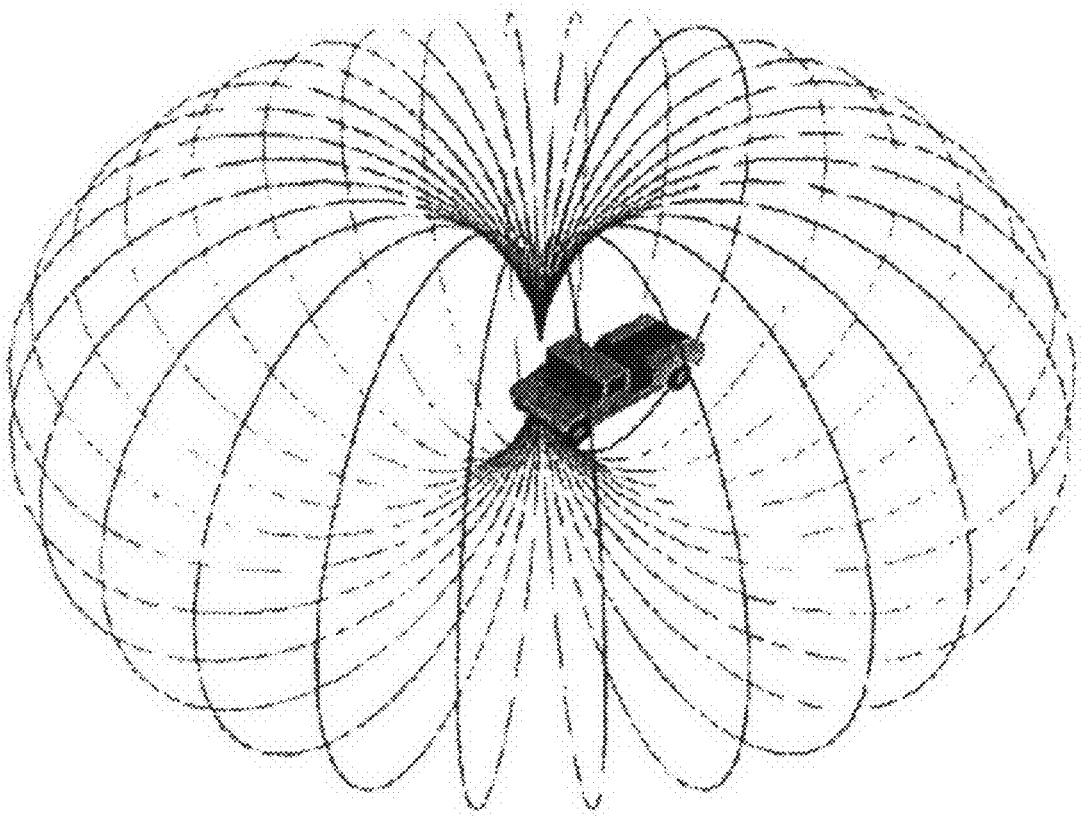

FIGS. 6A, 6B and 6C depict the toroid-shaped pattern typically generated by a monopole radiator, and the pattern depicted in these figures is also preferably produced by electromagnetic radiating device 12 of jammer 10 of the present invention.

Figure 4:
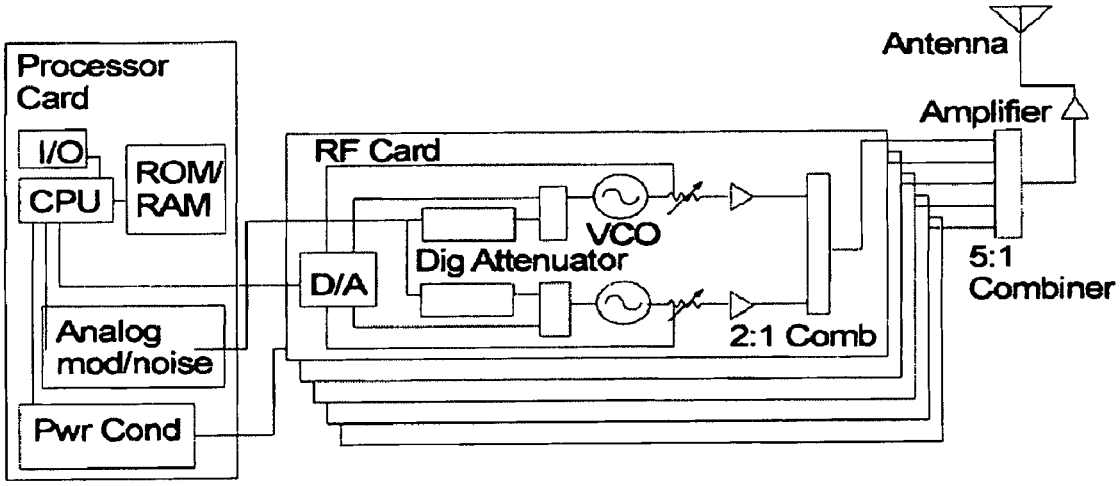
FIG. 4 is a block diagram of an embodiment of the present invention.
Figure 5:
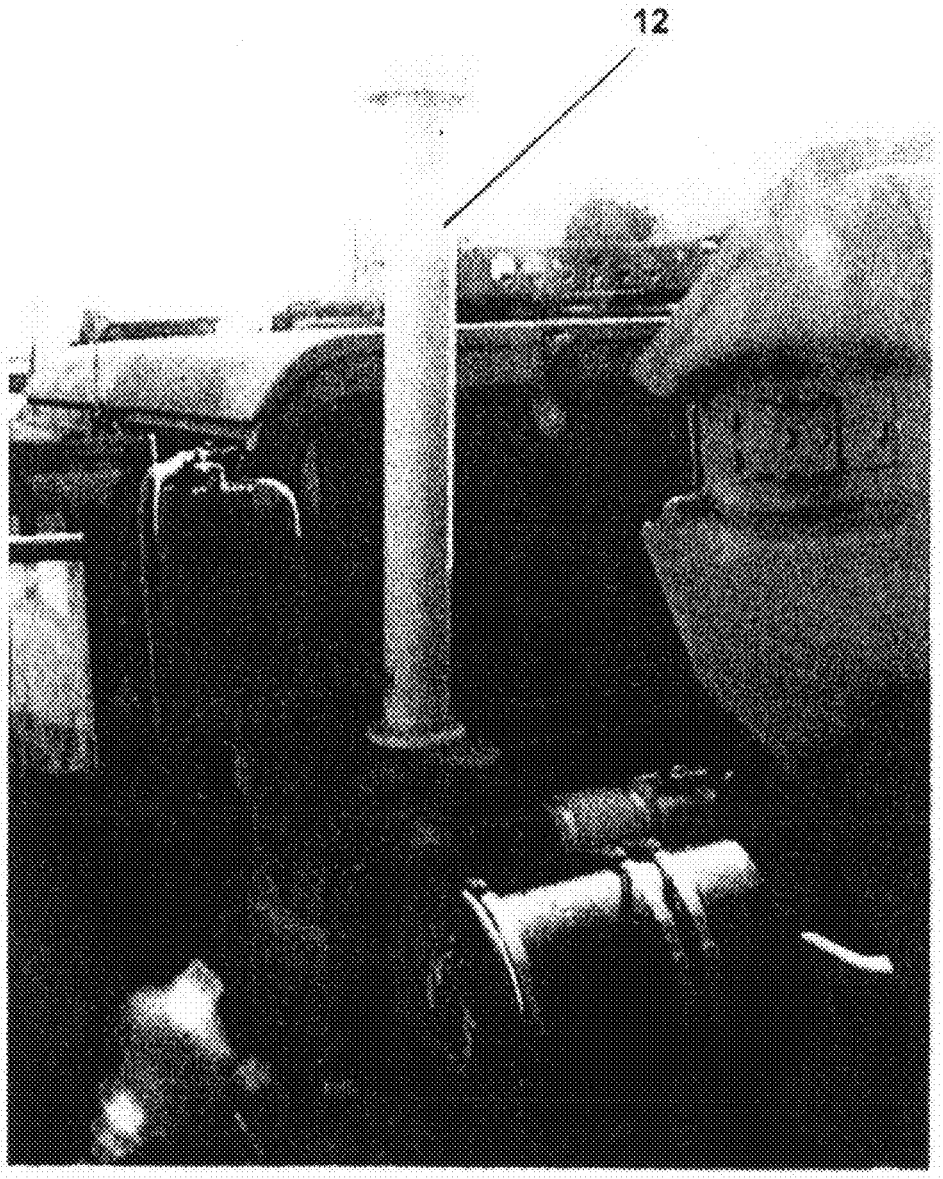
FIG. 5 is an image showing an electromagnetic radiating device used in an embodiment of the present invention.

FIG. 4 is a block diagram of preferred control electronics for an embodiment of the present invention. As shown therein, electronics unit 14 of jammer 10 preferably comprises a plurality of analog radio frequency (RF) modulator cards. Each card preferably comprises two digital attenuators, two voltage controlled oscillators (VCO's), two analog modulation blocks, two power amplifiers and a single 2-way combiner. The processor card (see FIG. 4) preferably comprises a central processing unit (CPU), a Gaussian noise generator, and various digital logic control circuits that provide the necessary inputs to each RF modulator card. As depicted in FIG. 4, the outputs from each of the analog modulator cards are preferably combined in a combiner before being passed to a wide-band antenna. A backplane for the antenna is preferably disposed as depicted in FIG. 3.

By applying Gaussian noise from the Gaussian noise generator through the digital attenuators and the VCOs on each RF modulator card, the bandwidth is easily adjustable and programmable. The higher the attenuation is, the narrower the bandwidth. The bandwidth can preferably be varied from a narrow spike to about 40% of the center frequency.

Jammer 10 is preferably easily manufacturable using low cost components and modular to allow for the changing of major components, as well as for troubleshooting and repairing jammer 10. The primary components of the jammer of the present invention preferably include: A wide band antenna, microprocessor card, high frequency (HF) RF card, a Very High Frequency (VHF1) RF Card, an Ultra-High Frequency (UHF1) RF Card, a second Ultra-High Frequency (UHF2) RF Card, and an L-Band RF card covering a lower end of frequencies. Each RF card preferably provides two frequencies in the appropriate frequency range.

While the power required to jam a RF device varies according to the particular device desired to be jammed, the present invention is preferably capable of transmitting at least about 10 watts of electromagnetic radiation from 25 MHz to 1000 MHz (continuous coverage). While an antenna of almost any size produces desirable results, it is preferable that electromagnetic radiating device 12 be less than or equal to about 32 inches high by about 4 inches in diameter. Electromagnetic radiating device 12 of the present invention also preferably has no active components. The antenna of electromagnetic radiating device 12 is preferably housed in a rugged radome capable of withstanding mechanical and environmental stresses and may be mounted externally or internally to any vehicle using a magnetic mount or other fastening element, system, or apparatus. Furthermore, electromagnetic radiating device 12 of the present invention is intended to appear to be part of the normal equipment commonly found on military vehicles, including but not limited to a Deep Water Fording kit.

Although reprogramming of the present invention can be accomplished in the field, it is preferable that such programming be performed by a depot level maintenance function. A more highly trained in theater military technician, a contractor in theater technician, or a technician at the contractor facility can preferably perform this function.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A method for preventing the detonation of a radio frequency controlled explosive device, the method comprising:

selecting a frequency range, said range comprising the operating frequency of a receiver of the explosive device; and transmitting electromagnetic waves comprising noise at frequencies of the selected frequency range, wherein transmitting comprises transmitting electromagnetic waves having a power of at least 1 watt.

2. The method of claim 1 wherein transmitting is performed while varying a location of a transmitter of the electromagnetic radiation.

3. The method of claim 1 further comprising modulating the electromagnetic radiation using at least one mode selected from the group consisting of $\Delta P/\Delta T$, $\Delta F/\Delta T$, and frequency hop.

4. The method of claim 1 further comprising varying one or more characteristics of the electromagnetic radiation selected from the group consisting of frequency, bandwidth, modulation mode, and power level.

5. The method of claim 4 further comprising programming the desired characteristics.

6. The method of claim 5 wherein programming the desired characteristics is performed by depot level maintenance personnel.

7. The method of claim 4 wherein the bandwidth is variable from a narrow spike to approximately 40% of the center frequency.

8. The method of claim 1 wherein selecting comprises avoiding frequency ranges of devices which should not be interfered with.

9. The method of claim 1 further comprising downloading a threat database update.

10. The method of claim 1 wherein the noise comprises Gaussian noise.

11. The method of claim 1 wherein transmitting comprises transmitting electromagnetic waves having a power of at least 10 watts.

12. A method for preventing the detonation of a radio-controlled explosive device comprising:

programming one or more frequencies into a processor; and transmitting electromagnetic waves comprising noise at the one or more frequencies, wherein transmitting comprises transmitting electromagnetic waves having a power of at least 1 watt.

13. The method of claim 12 wherein the one or more frequencies comprises a frequency or range of frequencies that include an operating frequency of the explosive device.

14. The method of claim 12 wherein transmitting comprises transmitting electromagnetic waves having a power of at least 10 watts.

15. The method of claim 12 wherein the noise comprises Gaussian noise.

16. The method of claim 12 further comprising varying one or more characteristics of the electromagnetic waves selected from the group consisting of frequency, bandwidth, modulation mode, and power level.

17. The method of claim 12 wherein the one or more frequencies comprises a single center frequency.

18. The method of claim 12 wherein the one or more frequencies comprises a plurality of frequencies defining a frequency range.

* * * * *